US007893910B2

(12) United States Patent
Feng

(10) Patent No.: US 7,893,910 B2
(45) Date of Patent: Feb. 22, 2011

(54) METHOD FOR DRIVING LIQUID CRYSTAL DISPLAY VIA CIRCULARLY REVERSING POLARITIES OF PIXELS THEREOF

(75) Inventor: Sha Feng, Shenzhen (CN)

(73) Assignees: Innocom Technology (Shenzhen) Co., Ltd., Shenzhen, Guangdong Province (CN); Chimel Innolux Corporation, Miao-Li County (TW)

( * ) Notice: Subject to any disclaimer, the term of this patent is extended or adjusted under 35 U.S.C. 154(b) by 678 days.

(21) Appl. No.: 12/005,729

(22) Filed: Dec. 28, 2007

(65) Prior Publication Data

US 2008/0158128 A1 Jul. 3, 2008

(30) Foreign Application Priority Data

Dec. 29, 2006 (TW) ..... 95149681 A

(51) Int. Cl.
*G09G 3/36* (2006.01)

(52) U.S. Cl. ..... 345/96

(58) Field of Classification Search ..... 345/96
See application file for complete search history.

(56) References Cited

U.S. PATENT DOCUMENTS 6,342,876 B1 * 1/2002 Kim ..... 345/96
7,196,697 B2 * 3/2007 Yamazaki ..... 345/96
2005/0264508 A1 * 12/2005 Nakamura et al. ..... 345/89
2005/0275611 A1 * 12/2005 Aoki ..... 345/96
2008/0284706 A1 * 11/2008 Van Dalfsen et al. ..... 345/96

FOREIGN PATENT DOCUMENTS

CN 1705006 A 12/2005
JP 10104576 A * 4/1998

* cited by examiner

*Primary Examiner*—Bipin Shalwala
*Assistant Examiner*—Ryan A Lubit
(74) *Attorney, Agent, or Firm*—Wei Te Chung

(57) ABSTRACT

An exemplary method for driving a liquid crystal display (200) includes: (a) providing a liquid crystal panel (20) including a plurality of pixels (205) arranged in a matrix to define sub-matrices of pixels, each sub-matrix including a plurality of pixel blocks; (b) providing a predetermined polarity pattern for each pixel block for a first frame period, such that each pixel has a predetermined polarity; (c) reversing the polarity of one of the pixels of each pixel block of each sub-matrix in each successive frame period, wherein a different pixel of each pixel block has its polarity reversed with each succeeding frame period, such that in one cycle of frame periods the polarities of all the pixels in each pixel block are reversed once only, and after each pixel block has its polarity reversed, the polarity of the pixel block is maintained for at least four successive frames periods.

20 Claims, 7 Drawing Sheets

METHOD FOR DRIVING LIQUID CRYSTAL DISPLAY VIA CIRCULARLY REVERSING POLARITIES OF PIXELS THEREOF

FIELD OF THE INVENTION

The present invention relates to methods for driving liquid crystal displays, and more particularly to a method for driving a liquid crystal display via circularly reversing polarities of pixels of a pixel block thereof.

GENERAL BACKGROUND

In the following description, unless the context indicates otherwise, a reference to a "pixel" includes a reference to a picture element of a liquid crystal display and/or a reference to a region of the liquid crystal display corresponding to the picture element.

A liquid crystal display utilizes liquid crystal molecules to control light transmission in each pixel. The liquid crystal molecules are driven according to external video signals received by the liquid crystal display. A conventional liquid crystal display generally employs a selected one of a frame inversion system, a line inversion system, or a dot inversion system to drive the liquid crystal molecules. Each of these driving systems can protect the liquid crystal molecules from decay or damage.

A typical method relating to the dot inversion system is so-called 2-line inversion driving. FIG. 8 schematically illustrates a series of polarity patterns of part of a liquid crystal display using a conventional 2-line inversion driving method. In order to simplify the following explanation, only 4×4 pixels forming a sub-matrix are shown. Other pixels of the liquid crystal display have a polarity arrangement similar to the illustrated sub-matrix. As shown in FIG. 8, a polarity of each pixel in a first row is the same as a polarity of an adjacent pixel in a second row. A polarity of each pixel in a third row is the same as a polarity of an adjacent pixel in a fourth row, and is opposite to the polarity of the adjacent pixel in the second row. Polarities of the pixels in each column are opposite to the polarities of the adjacent pixels in each of the adjacent columns. Moreover, the polarity of each pixel is reversed once in every frame period.

By adopting the 2-line inversion driving method, the polarity of each pixel in a current frame is opposite to that in the previous frame and opposite to that in the next frame. Thereby, liquid crystal molecules in the liquid crystal display are protected from decay or damage.

However, when all the pixels are enabled and display video signals having the same gray level, a kind of brightness difference problem occurs between pixels in odd and even rows. Consider pixels A and B shown in FIG. 8 for example. Pixel A is in the third row and the first column, and pixel B is in the fourth row and the first column. FIG. 9 is a waveform diagram showing the waveforms of signals applied to pixels A and B. Scanning signals Vga and Vgb in the form of square waves are sequentially applied to pixels A and B in every frame period. An ideal waveform of the data signals applied to pixels A and B (shown as Vd1 in FIG. 8) should also be a square wave. However, due to interaction between the circuitries of the two corresponding adjacent pixels in the first column, signal distortion is liable to occur. As a result, the actual waveform of the data signals applied to pixels A and B is much like Vd2 as shown in FIG. 8.

In detail, in the (N−1)th frame period, pixel C in the second row and the first column has a positive polarity, and pixels A and B both have negative polarities. Because the video signals are applied to the pixels in a column sequentially, the positive polarity of pixel C may cause pixel A to be charged insufficiently, whereby the signal distortion is generated. This causes the brightness of pixel A to be less than that of pixel B. For the same reason, pixel A is not charged as sufficiently as pixel B in the Nth frame period and in the (N+1)th frame period. That is, the brightness of pixel A is always less than that of pixel B. Similarly, the brightness of the two pixels in the other pixel pairs like pixels A and B are always different from each other when a same gray level voltage is applied. Thus, the 2-line inversion driving method is liable to generate such differences in brightness between odd and even rows of the matrix of pixels of the liquid crystal display, and accordingly the display quality of the liquid crystal display may be unsatisfactory.

It is, therefore, desired to provide a method for driving a liquid crystal display which can overcome the above-described deficiencies.

SUMMARY

In a first aspect, a method for driving a liquid crystal display includes: A method for driving a liquid crystal display, the method comprising: (a) providing a liquid crystal panel, wherein the liquid crystal panel includes a plurality of pixels arranged in a matrix, the matrix defining sub-matrices of pixels, each sub-matrix including a plurality of pixel blocks; (b) providing a predetermined polarity pattern for each pixel block for a first frame period, such that each pixel of the pixel block has a predetermined polarity; (c) reversing the polarity of one of the pixels of each pixel block of each sub-matrix in each successive frame period, wherein a different pixel of each pixel block has its polarity reversed with each succeeding frame period, such that in one cycle of frame periods the polarities of all the pixels in each pixel block are reversed once only, and after each pixel block has its polarity reversed, the polarity of the pixel block is maintained for at least four successive frames periods; and (d) repeating the procedure described in (c).

In a second aspect, a method for driving a liquid crystal display includes: (a) providing a liquid crystal panel, wherein the liquid crystal panel includes a plurality of pixel blocks, and each pixel block includes a plurality of pixels; (b) predetermining a polarity of each pixel of each pixel block for a first frame period, thereby defining an initial polarity pattern of the pixel block; and (c) reversing the polarity of only one pixel in each pixel block in each successive frame period, wherein a new different pixel of the pixel block has its polarity reversed with each succeeding frame period until all of the pixels of the pixel block have had their polarities reversed once and a polarity pattern of the pixel block has returned to the initial polarity pattern.

Other novel features and advantages will become more apparent from the following detailed description when taken in conjunction with the accompanying drawings.

DETAILED DESCRIPTION OF PREFERRED EMBODIMENTS

Reference will now be made to the drawings to describe preferred and exemplary embodiments of the present invention in detail.

Figure 1:
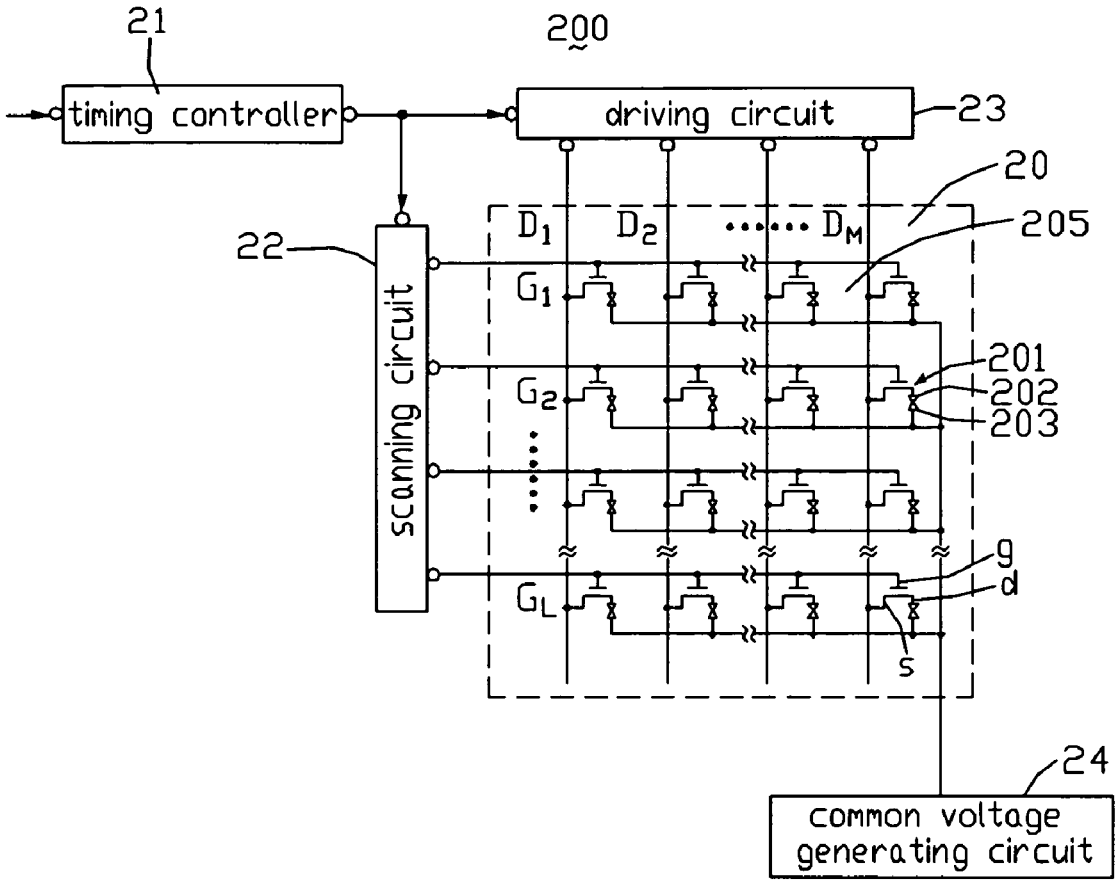
FIG. 1 is an abbreviated circuit diagram of a liquid crystal display capable of utilizing a driving method in accordance with any of various embodiments of the present invention.

FIG. 1 is an abbreviated circuit diagram of a liquid crystal display 200, which is capable of utilizing any of various driving methods according to the present invention. The liquid crystal display 200 includes a liquid crystal panel 20, a timing controller 21, a scanning circuit 22, a driving circuit 23, and a common voltage generating circuit 24.

The liquid crystal panel 20 includes a plurality of scan lines G1~GL (L>1) electrically coupled the scanning circuit 22, a plurality of data lines D1~DM (M>1) electrically coupled to the driving circuit 23, and a plurality of pixels 205 cooperatively defined by the crossing scan lines G1~GL and data lines D1~DM. Each pixel 205 includes a thin film transistor (TFT) 201, a pixel electrode 202, a common electrode 203, and liquid crystal molecules (not labeled) interposed between the pixel electrode 202 and the common electrode 203. The TFT 201 is disposed near an intersection of a corresponding one of the scan lines G1~GL and a corresponding one of the data lines D1~DM. A gate electrode of the TFT 201 is electrically coupled to the corresponding one of the scan lines G1~GL, a source electrode of the TFT 201 is electrically coupled to the corresponding one of the data lines D1~DM, and a drain electrode of the TFT 201 is electrically coupled to the pixel electrode 202. The common electrode 203 is electrically coupled to the common voltage generating circuit 24, and the common voltage generating circuit 24 is configured to provide a common voltage for all the pixels 205.

In operation of the liquid crystal display 200, the scanning circuit 22 supplies a scanning voltage to switch the TFT 201 on via the corresponding one of the scan lines G1~GL. The driving circuit 220 supplies a data voltage to the pixel electrode 202 via the corresponding one of the data lines D1~DM. The common voltage generating circuit 24 supplies a common voltage to the common electrode 203. Thereby, an electric field is generated between the pixel electrode 202 and the common electrode 203. The electric field causes the liquid crystal molecules of the pixel 205 to twist to a corresponding angle, so as to control the light transmission of the pixel 205, whereby the pixel 205 displays an image element having a corresponding gray level.

The direction of the electric field needs to be varied periodically, in order that decay of or damage to the liquid crystal molecules can be prevented. The present invention provides a method for driving the liquid crystal display 200 to accomplish such need. A first embodiment of such method is as follows. To simplify the following explanation, some definitions are provided first. When the data voltage is higher than the common voltage of the common electrode 203, a direction of the electric field is from the pixel electrode 202 to the common electrode 203, and the pixel 205 is defined as having a positive polarity. Conversely, when the data voltage is lower than the common voltage of the common electrode 203, a direction of the electric field is from the common electrode 203 to the pixel electrode 202, and the pixel 205 is defined as having a negative polarity. Moreover, when absolute values of the data voltages applied to the pixel electrodes 202 of two pixels 205 are the same, with the data voltages only differing in polarity, the gray levels of the two pixels 205 are assumed to be the same.

All the pixels 205 of the liquid crystal panel 20 are divided into a plurality of sub-matrices. Each of the sub-matrices includes 2K×2K pixels, where K represents a natural number not less than 2, and not larger than the smaller of L/2 and M/2.

In the first embodiment, K being equal to 2 is taken as an example. Thus, each sub-matrix includes 4×4 pixels 205. That is, each sub-matrix includes four rows and four columns, and each row and each column respectively includes four pixels 205. Moreover, all the 4×4 pixels 205 in the sub-matrix can be divided into a first pixel block, a second pixel block, a third pixel block, and a fourth pixel block. Each of the pixel blocks includes 2×2 pixels 205. In particular, the pixels 205 of first pixel block are located in the first and second rows and in the first and second columns. The pixels 205 of the second pixel block are located in the first and second rows and in the third and fourth columns. The pixels 205 of the third pixel block are located in the third and fourth rows and in the third and fourth columns. The pixels 205 of the fourth pixel block are located in the third and fourth rows and in the first and second columns. Furthermore, each pixel block includes a first pixel, a second pixel, a third pixel, and a fourth pixel. The first pixel, the second pixel, the third pixel, and the fourth pixel are respectively arranged clockwise in the corresponding pixel block, starting from the top left pixel in the pixel block.

Figure 2:
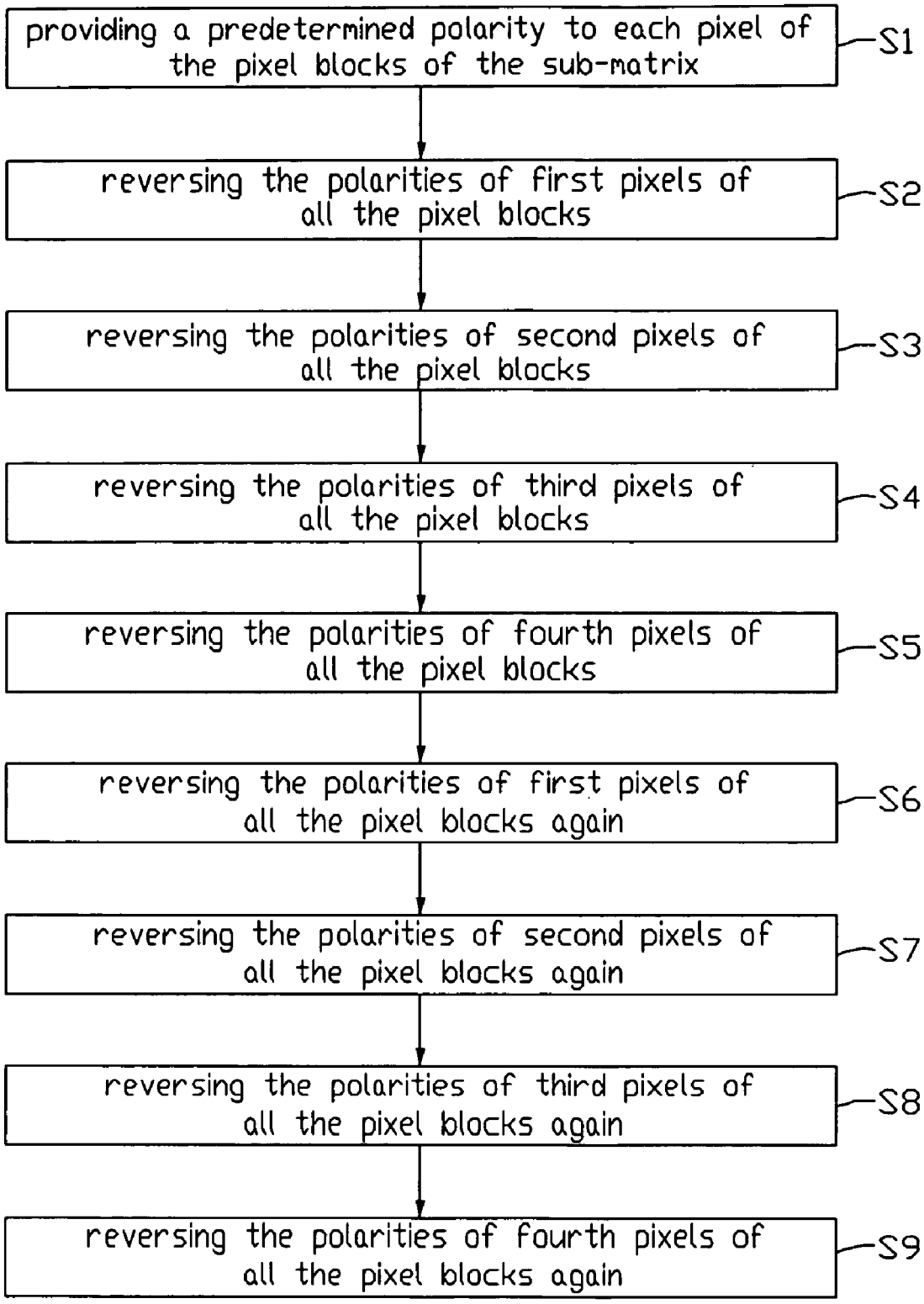
FIG. 2 is a flow chart of a method for driving the liquid crystal display of FIG. 1 according to a first embodiment of the present invention.
Figure 3:
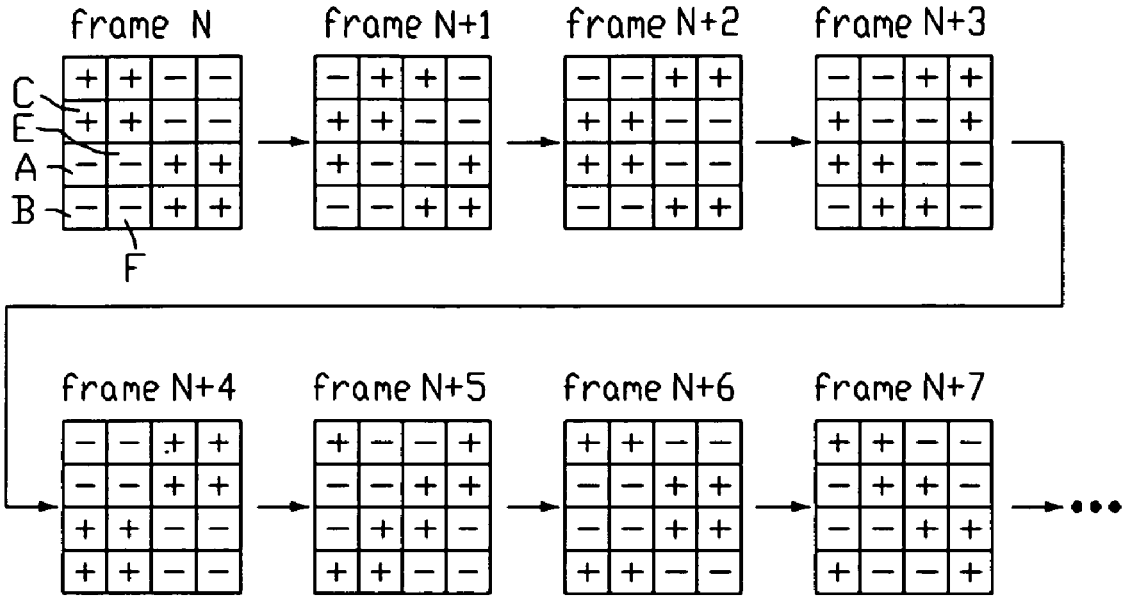
FIG. 3 illustrates a series of polarity patterns of 4×4 pixels of a sub-matrix of the liquid crystal display of FIG. 1 during eight continuous frames according to the driving method of FIG. 2, the sub-matrix including pixel A and pixel B.

Referring to FIGS. 2-3, the driving method of the first embodiment includes the following steps: S1, providing a predetermined polarity to each pixel of the pixel blocks of the sub-matrix; S2, reversing the polarities of the first pixels of all the pixel blocks; S3, reversing the polarities of the second pixels of all the pixel blocks; S4, reversing the polarities of the third pixels of all the pixel blocks; S5, reversing the polarities of the fourth pixels of all the pixel blocks; S6, reversing the polarities of the first pixels of all the pixel blocks again; S7, reversing the polarities of the second pixels of all the pixel blocks again; S8, reversing the polarities of the third pixels of all the pixel blocks again; and S9, reversing the polarities of the fourth pixels of all the pixel blocks again.

In step S1, as shown in the Nth frame of FIG. 3, the polarities of the pixels 205 in the first, second, third, and fourth rows of the sub-matrix are respectively predetermined to be "+ + − −", "+ + − −", "− − + +", and "− − + +" along a direction from the first column to the fourth column. Thereby, the polarities of the corresponding pixels of the first and fourth pixel blocks are all positive, and the polarities of the corresponding pixels of the second and third pixel blocks are all negative.

In step S2, the polarities of the first pixels are reversed. As shown in the (N+1)th frame of FIG. 3, the polarities of the pixels 205 in the first, second, third, and fourth rows of the sub-matrix are respectively converted to "− + + −", "+ + − −", "+ − − ++", and "− − + +" along a direction from the first column to the fourth column.

In step S3, the polarities of the second pixels are reversed. As shown in the (N+2)th frame of FIG. 3, the polarities of the pixels 205 in the first, second, third, and fourth rows of the sub-matrix are respectively converted to "− − +++", "+ + − −", "+ + − −", and "− − + +" along the direction from the first column to the fourth column.

In step S4, the polarities of the third pixels are reversed. As shown in the (N+3)th frame of FIG. 3, the polarities of the pixels 205 in the first, second, third, and fourth rows of the sub-matrix are respectively converted to "− − + +", "+ − − +", and "+ + − −", along "− + + −" the direction from the first column to the fourth column.

In step S5, the polarities of the fourth pixels are reversed. As shown in the (N+4)th frame of FIG. 3, the polarities of the pixels 205 in the first, second, third, and fourth rows of the sub-matrix are respectively converted to "− − + +", "− − + +", "+ + − −", and "+ + − −" along the direction from the first column to the fourth column.

In step S6, the polarities of the first pixels are reversed again. As shown in the (N+5)th frame of FIG. 3, the polarities of the pixels 205 in the first, second, third, and fourth rows of the sub-matrix are respectively converted to "+ − − +", "− − + +", "− + + −", and "+ + − −" along the direction from the first column to the fourth column.

In step S7, the polarities of the second pixels are reversed again. As shown in the (N+6)th frame of FIG. 3, the polarities of the pixels 205 in the first, second, third, and fourth rows of the sub-matrix are respectively converted to "+ + − −", "− − + +", "− − + +", and "+ + − −" along the direction from the first column to the fourth column.

In step S8, the polarities of the third pixels are reversed again. As shown in the (N+7)th frame of FIG. 3, the polarities of the pixels 205 in the first, second, third, and fourth rows of the sub-matrix are respectively "+ + − −", "− + + −", "− − + +", and "+ − − +" along the direction from the first column to the fourth column.

In step S9, the polarities of the fourth pixels are reversed again. Thereby, the polarities of the pixels 205 in the first, second, third, and fourth rows of the sub-matrix are respectively converted to be the same as the predetermined polarities. That is, the polarities of the pixels 205 in the first, second, third, and fourth rows of the sub-matrix are respectively converted to be "+ + − −", "+ + − −", "− − + +", and "− − + +" along the direction from the first column to the fourth column. Moreover, the driving method typically further includes repeating the set of steps S2-S9 after step S9. Thus, a minimum repeating period of time of the driving method is eight continuous frame periods.

The above-described driving method can be generalized to all the sub-matrices of the liquid crystal panel 20 of the liquid crystal display 200. That is, the sub-matrix is defined as a minimum repeating unit, and the polarity of each pixel 205 in each sub-matrix is the same as that of the corresponding pixels 205 of the other sub-matrices when the liquid crystal display 200 is in operation.

The above-described driving method can be summarized as follows. Firstly, in each pixel block of each sub-matrix of the liquid crystal display 200, only one of the pixels 205 reverses the polarity thereof in two adjacent frames. In particular, the pixels 205 of each pixel block reverse the polarities thereof clockwise and circularly, starting from the top left pixel in the pixel block. Secondly, once the polarity of the pixel 205 is reversed in current frame, the polarity thereof is retained in four continuous frames (including the current frame). Thirdly, the polarity of each pixel 205 is reversed once in every four continuous frames. Fourthly, the polarities of the corresponding pixels 205 of two adjacent pixel blocks are opposite to each other, such that the polarities of the corresponding pixels 205 of the first and fourth pixel blocks are the same, and the polarities of the corresponding pixels 205 of the second and third pixel blocks are the same in each frame. Fifthly, the polarities of the first, second, third, and fourth pixels 205 of each pixel block are respectively selected from a corresponding one in the group of: "+ + + +", "− + + +", "− − + +", "− − − +", "− − − −", "+ − − −", "+ + − −", and "+ + + −".

By adopting the above-described driving method, the differences in brightness between odd and even rows of the matrix of the pixels that might be otherwise generated in a liquid crystal display adopting the 2-lines inversion driving method can be reduced. Pixels A, B, E, F in FIG. 3 are taken as an example for explanation as follow, with pixels A, B, E, F respectively being the first pixel, the fourth pixel, the second pixel, and the third pixel of the fourth pixel block.

Figure 4:
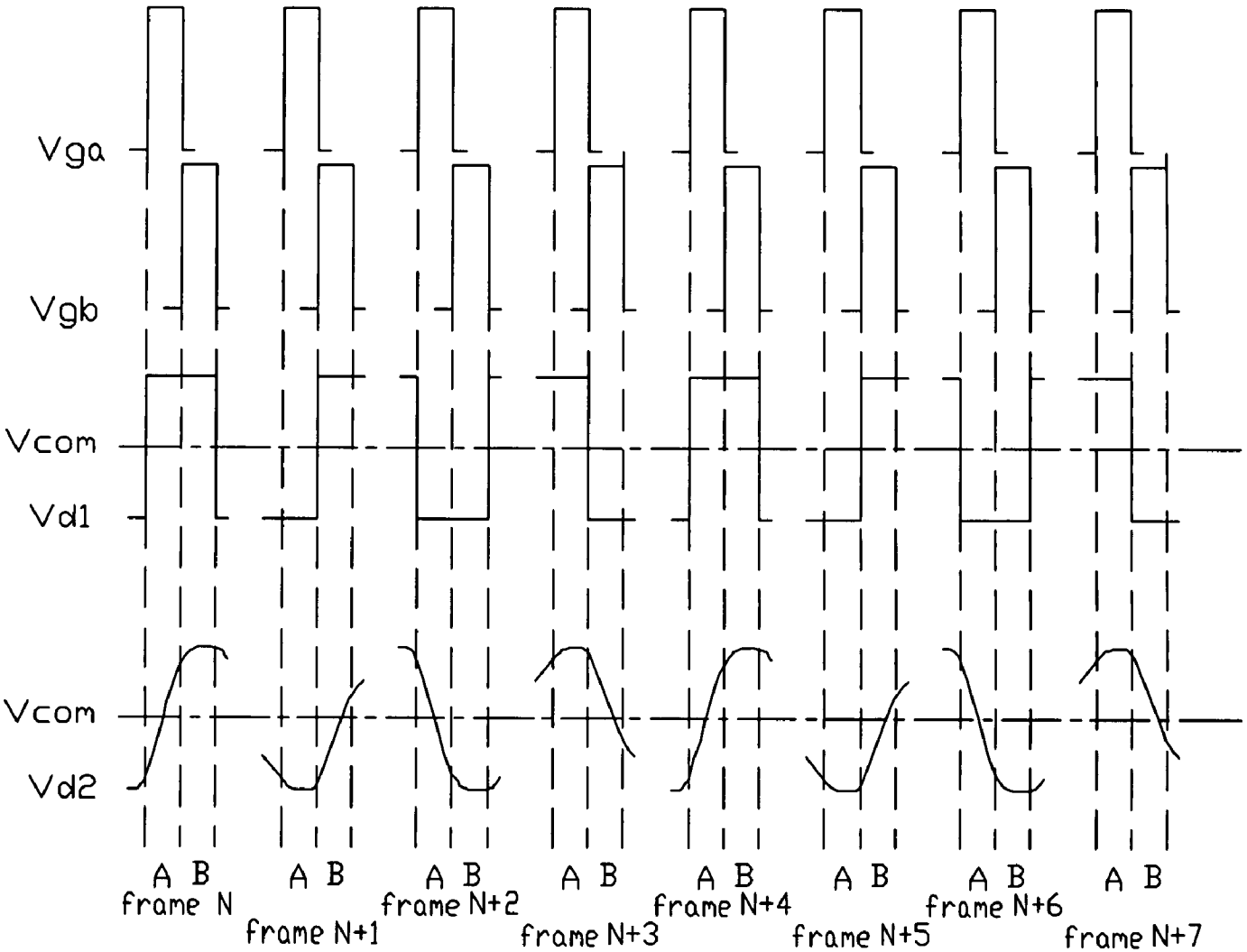
FIG. 4 is a waveform diagram showing signals of the liquid crystal display of FIG. 1 during the eight continuous frames according to the driving method of FIG. 2, the signals including scanning voltages, a common voltage, and ideal and real data voltages applied to pixels A and B.

FIG. 4 is a waveform diagram showing the waveforms of signals applied to pixels A and B. Scanning voltage Vga and Vgb in the form of square wave are sequentially applied to pixels A and B in each frame period. An ideal waveform of the data voltages applied to pixels A and B (shown as Vd1 in FIG. 4) should also be square waves. However, due to interaction between the circuitries of the two corresponding adjacent pixels in the first column, signal distortion is liable to occur. As a result, the actual waveform of the data voltages applied to pixels A and B is much like Vd2 as shown in FIG. 4.

In an Nth frame period, when that all pixels are enabled and display image elements having a same gray level, pixel C of the first pixel block in the sub-matrix has a positive polarity, and pixels A and B both have negative polarities, as shown is FIG. 3. Because pixels C, A, B are all in the first column, and the data voltages are applied to pixels C, A, B sequentially via the corresponding data line D1, thus the positive polarity of pixel C may cause pixel A to be charged insufficiently. However, due to the negative polarity of pixel A, pixel B can be charged sufficient. This causes the brightness of pixel A to be less than that of pixel B in the Nth frame period. For the same reason, the brightness of pixel E is less than that of pixel F in the Nth frame period.

When the liquid crystal display 200 turns to an (N+1)th frame period, pixels C and A both have positive polarities, and pixel B has a negative polarity, as shown is FIG. 3. The positive polarity of pixel A may cause pixel B to be charged insufficiently. However, because the polarity of pixel A is the same as that of pixel C, thus pixel A can be charged sufficiently. This causes the brightness of pixel A is greater than that of pixel B, and similarly the brightness of pixel E is less than that of pixel F in the (N+1)th frame period.

Similarly, in an (N+2)th frame period, the brightness of pixel A is greater than that of pixel B, and the brightness of pixel E is greater than that of pixel F. In an (N+3)th frame period, the brightness of pixel A is greater than that of pixel B, and the brightness of pixel E is less than that of pixel F. In an (N+4)th frame period, the brightness of pixel A is less than that of pixel B, and the brightness of pixel E is less than that of pixel F. In an (N+5)th frame period, the brightness of pixel A is greater than that of pixel B, and the brightness of the pixel E is less than that of pixel F. In an (N+6)th frame period, the brightness of pixel A is greater than that of pixel B, and the brightness of pixel E is greater than that of pixel F. In an (N+7)th frame period, the brightness of pixel A is greater than that of pixel B, and the brightness of pixel E is less than that of pixel F.

Accordingly in each of the eight continuous frames periods, each row of pixels includes a plurality of pixels relatively brighter, and a plurality of pixels relatively darker. The relatively brighter pixels can compensate the relatively darker pixels, such that the problem of differences in brightness between odd and even rows of the matrix of pixels 205 can be solved or at least substantially circumvented. Therefore, by adopting the above-described driving method, display quality of the liquid crystal display 200 can be improved. Moreover, because the polarity of the pixel is retained in four continuous frames period, thus it is not necessary for each pixel to be charged from one polarity to an opposite polarity in every frame. Accordingly by adopting the above-described driving method, power consumption of the liquid crystal display 200 can be reduced.

Figure 5:
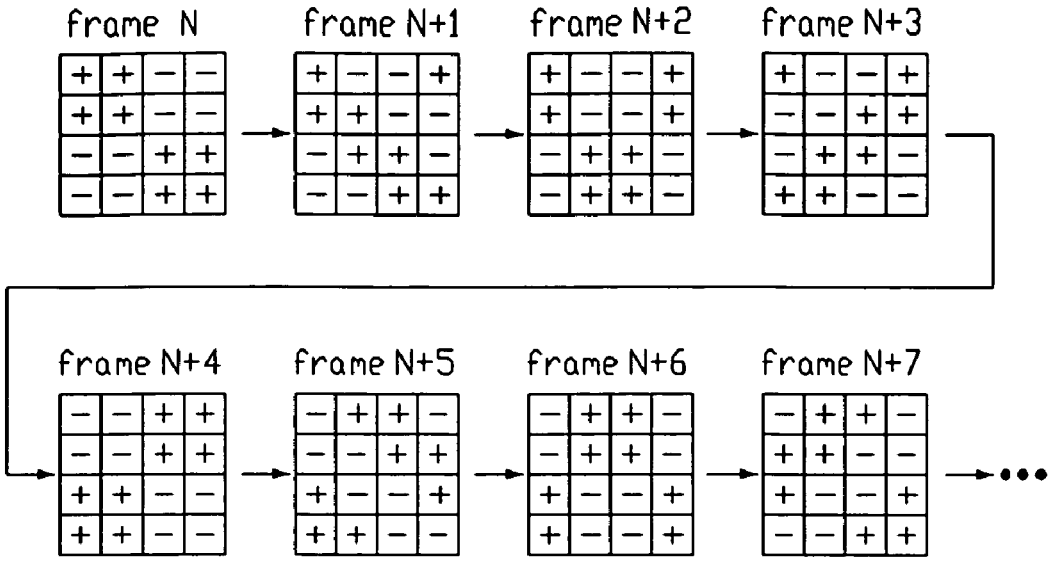
FIG. 5 illustrates a series of polarity patterns of 4×4 pixels of a sub-matrix of the liquid crystal display of FIG. 1 during eight continuous frames according to a driving method of a second embodiment of the present invention.

Furthermore, three alternative embodiments of the driving method of the present invention are described below. FIG. 5 illustrates a series of polarity patterns of 4×4 pixels of a sub-matrix of the liquid crystal display 200 of FIG. 1 during eight continuous frames according to a driving method of a second embodiment of the present invention. The second embodiment is similar in principle to the above-described first embodiment, and the predetermined polarity patterns of the second embodiment are the same as that of the first embodiment. However, the polarities of the pixels of each pixel block start to be reversed circularly from the second pixel of the pixel block.

Figure 6:
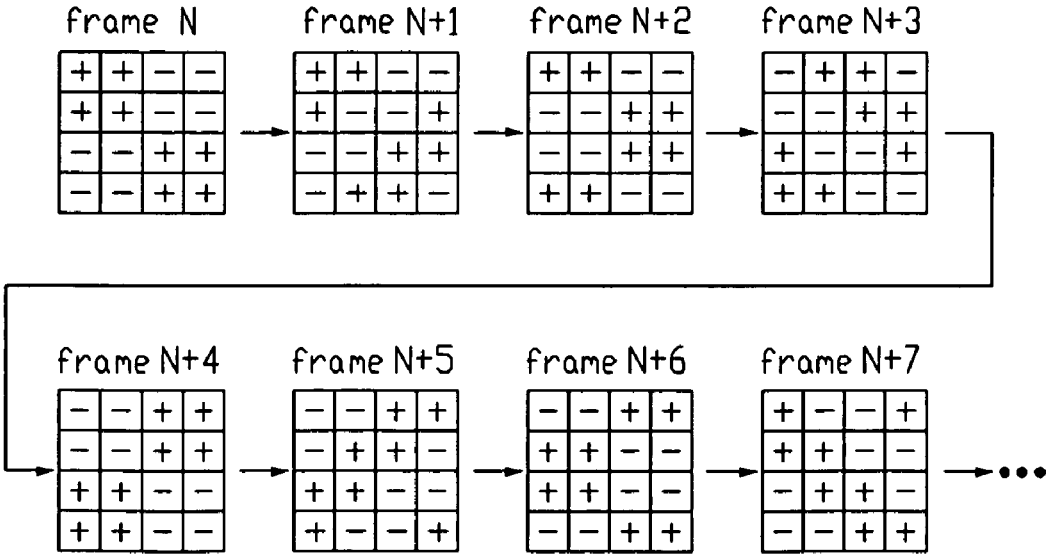
FIG. 6 illustrates a series of polarity patterns of 4×4 pixels of a sub-matrix of the liquid crystal display of FIG. 1 during eight continuous frames according to a driving method of a third embodiment of the present invention.

FIG. 6 illustrates a series of polarity patterns of 4×4 pixels of a sub-matrix of the liquid crystal display 200 of FIG. 1 during eight continuous frames according to a driving method of a third embodiment of the present invention. The third embodiment is similar in principle to the above-described first embodiment, and the predetermined polarity patterns of the third embodiment are the same as that of the first embodiment. However, the polarities of the pixels of each pixel block start to be reversed circularly from the third pixel of the pixel block.

Figure 7:
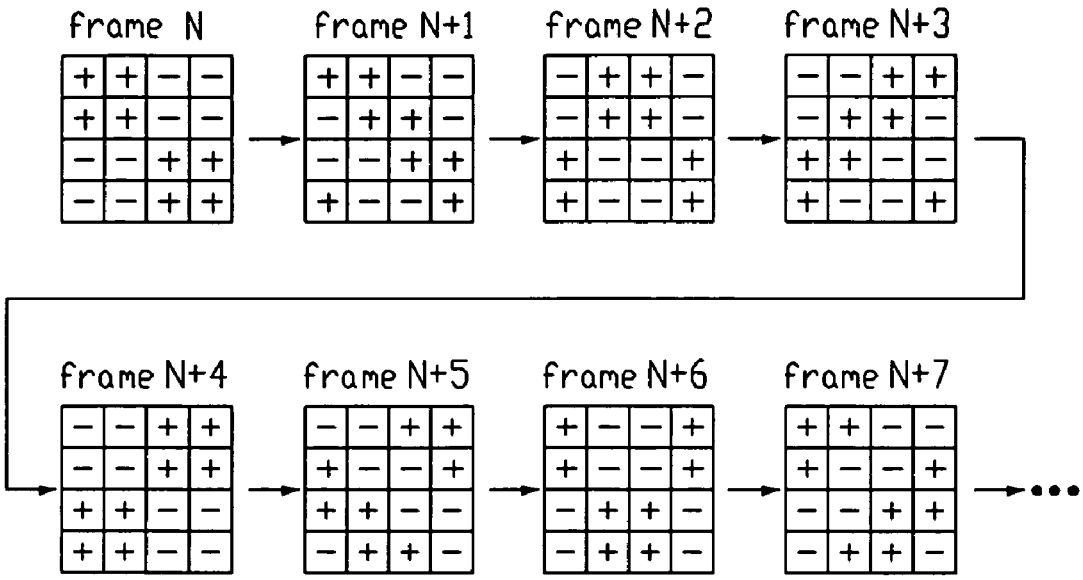
FIG. 7 illustrates a series of polarity patterns of 4×4 pixels of a sub-matrix of the liquid crystal display of FIG. 1 during eight continuous frames according to a driving method of a fourth embodiment of the present invention.
Figure 8:
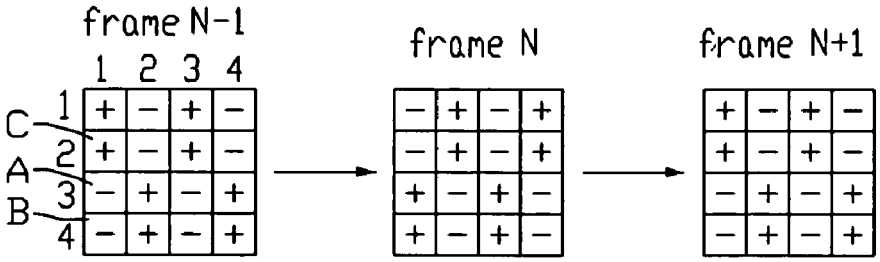
FIG. 8 (RELATED ART)
FIG. 8 illustrates a series of polarity patterns of 4×4 pixels of a liquid crystal display during three continuous frames using a conventional 2-line inversion driving method, the pixels including pixel A and pixel B.
Figure 9:
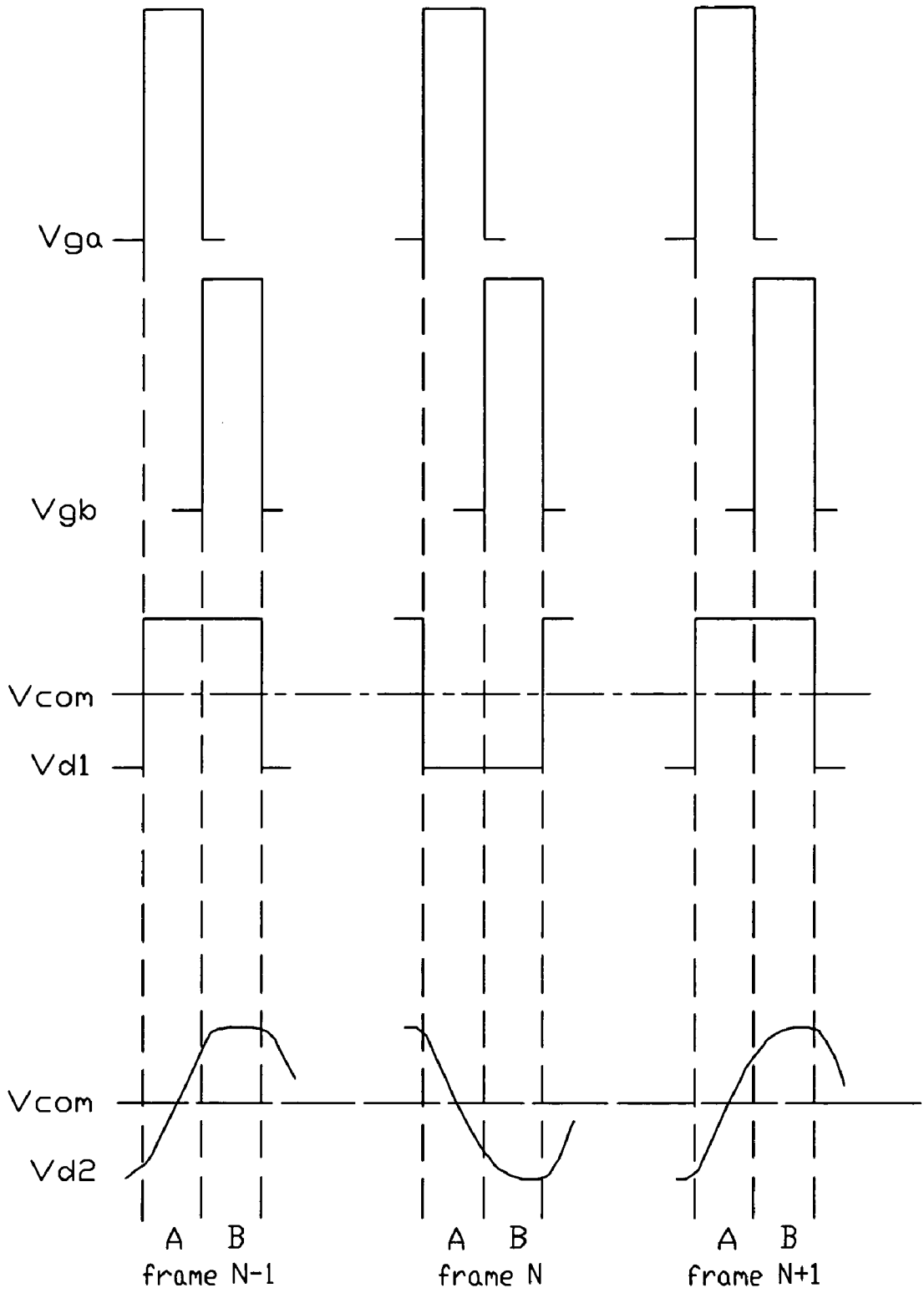
FIG. 9 (RELATED ART)
FIG. 9 is a waveform diagram showing signals of the liquid crystal display of FIG. 8 when the conventional 2-line inversion driving method is used, the signals including scanning signals, a common voltage signal, and ideal and real data signals applied to pixels A and B.

FIG. 7 illustrates a series of polarity patterns of 4×4 pixels of a sub-matrix of the liquid crystal display 200 of FIG. 1 during eight continuous frames according to a driving method of a fourth embodiment of the present invention. The fourth embodiment is similar in principle to the above-described first embodiment, and the predetermined polarity patterns of the fourth embodiment are the same as that of the first embodiment. However, the polarities of the pixels of each pixel block start to be reversed circularly from the fourth pixel of the pixel block.

Moreover, the polarity reversing in each pixel block can be in other sequences instead of the clockwise sequence. For example, the polarity reversing can be counterclockwise sequence, and can also be in the sequence of the first pixel, the third pixel, the second pixel, and the fourth pixel. Furthermore, the number K of each sub-matrix can be 3, 4, 5, etc., such that each pixel block includes 3×3 pixels, 4×4 pixels, 5×5 pixels, and the like.

It is to be further understood that even though numerous characteristics and advantages of preferred and exemplary embodiments have been set out in the foregoing description, together with details of the structures and functions of the embodiments, the disclosure is illustrative only; and that changes may be made in detail within the principles of the present invention to the full extent indicated by the broad general meaning of the terms in which the appended claims are expressed.

What is claimed is:

1. A method for driving a liquid crystal display, the method comprising:

(a) providing a liquid crystal panel, wherein the liquid crystal panel comprises a plurality of pixels arranged in a matrix, the matrix defining sub-matrices of pixels, each sub-matrix comprising a plurality of pixel blocks;

(b) providing a predetermined polarity pattern for each pixel block for a first frame period, such that each pixel of the pixel block has a predetermined polarity;

(c) reversing the polarity of one of the pixels of each pixel block of each sub-matrix in each successive frame period, wherein a different pixel of each pixel block has its polarity reversed with each succeeding frame period, such that in one cycle of frame periods the polarities of all the pixels in each pixel block are reversed once only, and after each pixel block has its polarity reversed, the polarity of the pixel block is maintained for at least four successive frames periods; and (d) repeating the procedure described in (c).

2. The method for driving a liquid crystal display as claimed in claim 1, wherein each pixel block includes a first pixel, a second pixel, a third pixel, and a fourth pixel arranged clockwise.

3. The method for driving a liquid crystal display as claimed in claim 2, wherein the polarities of the pixels of each pixel block are reversed clockwise during the procedure of (c).

4. The method for driving a liquid crystal display as claimed in claim 2, wherein the polarities of the pixels of each pixel block are reversed in a counterclockwise sequence during the procedure of (c).

5. The method for driving a liquid crystal display as claimed in claim 2, wherein each sub-matrix comprises a first pixel block, a second pixel block, a third pixel block, and a fourth pixel block arranged clockwise.

6. The method for driving a liquid crystal display as claimed in claim 5, wherein the polarities of the corresponding pixels of two directly adjacent pixel blocks are opposite to each other in each frame period.

7. The method for driving a liquid crystal display as claimed in claim 5, wherein the polarities of the corresponding pixels of two diagonally adjacent pixel blocks are the same in each frame period.

8. The method for driving a liquid crystal display as claimed in claim 1, wherein each sub-matrix is a minimum repeating unit, and the polarity of each pixel in each sub-matrix is the same as that of the corresponding pixels of the other sub-matrices.

9. The method for driving a liquid crystal display as claimed in claim 8, wherein a minimum repeating period comprises at least eight continuous frames periods.

10. The method for driving a liquid crystal display as claimed in claim 5, wherein the polarities of the pixels of the first pixel block and that of the third pixel block are all predetermined to be positive, and the polarities of the pixels of the second pixel block and that of the fourth pixel block are all predetermined to be negative in procedure of (b).

11. The method for driving a liquid crystal display as claimed in claim 10, wherein polarities of the pixels of each pixel block start to be reversed circularly from the first pixel of the corresponding pixel block in procedure of (c).

12. The method for driving a liquid crystal display as claimed in claim 10, wherein polarities of the pixels of each pixel block start to be reversed circularly from the second pixel of the corresponding pixel block in procedure of (c).

13. The method for driving a liquid crystal display as claimed in claim 10, wherein polarities of the pixels of each pixel block start to be reversed circularly from the third pixel of the corresponding pixel block in procedure of (c).

14. The method for driving a liquid crystal display as claimed in claim 10, wherein polarities of the pixels of each pixel block start to be reversed circularly from the fourth pixel of the corresponding pixel block in procedure of (c).

15. The method for driving a liquid crystal display as claimed in claim 10, wherein the polarities of the first, second, third, and fourth pixels of each pixel block are respectively selected from a corresponding one in the group of: "+ + + +", "− + + +", "− − + +", "− − − +", "− − − −", "+ − − −", "+ + − −", and "+ + + −".

16. A method for driving a liquid crystal display, the method comprising:

(a) providing a liquid crystal panel, wherein the liquid crystal panel comprises a plurality of pixel blocks, and each pixel block comprises a plurality of pixels;

(b) predetermining a polarity of each pixel of each pixel block for a first frame period, thereby defining an initial polarity pattern of the pixel block; and (c) reversing the polarity of only one pixel in each pixel block in each successive frame period, wherein a new different pixel of the pixel block has its polarity reversed with each succeeding frame period until all of the pixels of the pixel block have had their polarities reversed once and a polarity pattern of the pixel block has returned to the initial polarity pattern.

17. The method for driving a liquid crystal display as claimed in claim 16, wherein each pixel block includes a first pixel, a second pixel, a third pixel, and a fourth pixel clockwise, the polarities of the pixels of each pixel block are reversed in one of a clockwise sequence and a counterclockwise sequence.

18. The method for driving a liquid crystal display as claimed in claim 16, wherein the polarities of the corresponding pixels of two adjacent pixel blocks are opposite to each other in each frame period.

19. The method for driving a liquid crystal display as claimed in claim 16, wherein four pixel blocks define a minimum repeating unit, the polarity of each pixel in each sub-matrix is the same as that of the corresponding pixels of the other sub-matrices.

20. The method for driving a liquid crystal display as claimed in claim 16, further comprising: repeating the procedure described in (c).

* * * * *

UNITED STATES PATENT AND TRADEMARK OFFICE

CERTIFICATE OF CORRECTION

PATENT NO. : 7,893,910 B2
APPLICATION NO. : 12/005729
DATED : February 22, 2011
INVENTOR(S) : Sha Feng It is certified that error appears in the above-identified patent and that said Letters Patent is hereby corrected as shown below:

Title Page;
Please replace Section (73) regarding "Assignees" on the front page of the Patent with the following:

(73) Assignees: Innocom Technology (Shenzhen) Co., Ltd., Shenzhen, Guangdong Province (CN); Chimei Innolux Corporation, Miao-Li County (TW).

Signed and Sealed this
Seventh Day of June, 2011

David J. Kappos

David J. Kappos
*Director of the United States Patent and Trademark Office*